US009065198B2

(12) United States Patent
Uchida

(10) Patent No.: US 9,065,198 B2
(45) Date of Patent: Jun. 23, 2015

(54) CONNECTOR WITH FOREIGN SUBSTANCE ENTRANCE PREVENTING PORTION

(71) Applicant: Sumitomo Wiring Systems, Ltd., Yokkaichi, Mie (JP)

(72) Inventor: Masashi Uchida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 100 days.

(21) Appl. No.: 13/920,149

(22) Filed: Jun. 18, 2013

(65) Prior Publication Data

US 2014/0011383 A1 Jan. 9, 2014

(30) Foreign Application Priority Data

Jul. 6, 2012 (JP) ..... 2012-152640

(51) Int. Cl.
*H01R 13/40* (2006.01)
*H01R 13/52* (2006.01)

(52) U.S. Cl.
CPC ..... *H01R 13/5219* (2013.01)

(58) Field of Classification Search
CPC ..... H01R 13/4223; H01R 13/4362; H01R 13/5219; H01R 23/7073
USPC ..... 439/271, 595, 660, 752
See application file for complete search history.

(56) References Cited

U.S. PATENT DOCUMENTS

| | | | | |
|---|---|---|---|---|
| 4,979,912 | A * | 12/1990 | Shindo et al. | 439/595 |
| 5,067,913 | A * | 11/1991 | Sagawa | 439/595 |
| 6,488,547 | B2 * | 12/2002 | Tanaka | 439/752 |
| 6,604,966 | B1 * | 8/2003 | Hayes et al. | 439/752 |
| 6,666,708 | B2 * | 12/2003 | Saito | 439/466 |
| 7,108,551 | B2 * | 9/2006 | Nishide | 439/595 |
| 7,476,123 | B2 * | 1/2009 | Kobayashi et al. | 439/489 |
| 8,876,561 | B2 * | 11/2014 | Endo et al. | 439/752 |

FOREIGN PATENT DOCUMENTS

JP 2001-057269 2/2001

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector includes a first housing (30) and a second housing (50) with an accommodating portion (52) fittable to a fitting (31) on the first housing (30). Terminals (56) cross first and second connecting surfaces (34, 60) facing in a connecting direction in a connected state of the housings (30, 50). A lock arm (36) on the first housing (30) locks the housings (30, 50) in the connected state. A projection (63) is provided on the second connecting surface (60) at a position of projection of the lock arm (36) and has a second blocking surface (64) facing a first blocking surface (40) of the fitting (31). Foreign substance entrance projecting projections (65) on the second connecting surface (60) cover the intermediate terminals (56) crossing the first and second connecting surfaces (34, 60) and engage in foreign substance entrance preventing recesses (41) of the first connecting surface (34).

6 Claims, 11 Drawing Sheets

CONNECTOR WITH FOREIGN SUBSTANCE ENTRANCE PREVENTING PORTION

BACKGROUND

1. Field of the Invention

The invention relates to a connector.

2. Description of the Related Art

Japanese Unexamined Patent Pub. No. 2001-57269 discloses a connector with male and female housings. The male housing has a receptacle and the female housing has a fitting that can be inserted into the receptacle of the male housing and locked in a connected state. Male terminals project from the back wall of the receptacle of the male housing and pass through terminal insertion holes in the front wall of the fitting when the housings reach the connected state. Thus, the male terminals connect electrically to female terminals in the fitting.

A resiliently deformable lock arm extends obliquely up and back from the front wall of the fitting and a locking projection is formed on the lock arm. The locking projection fits into a lock hole in the receptacle of the male housing when the two housings reach the connected state, thereby locking the two housings in the connected state.

The above-described connector is used in oil, such as lubricant, and foreign substances, such as metal powder and metal pieces may float in the oil. The lock hole in the receptacle extends to the back wall of the receptacle and foreign substances, such as metal pieces, can enter the receptacle through a clearance between the lock hole and the lock arm even after the locking projection of the lock arm is fit into the lock hole. Additionally, the male and female housings can move relative to each other in a separating direction while in a locked state, such as when wires drawn out from the housing are pulled. Thus, a clearance is formed between the back wall of the receptacle and a connecting surface of the fitting. As a result, the terminals are exposed and foreign substances that have entered through the lock hole can contact and short the exposed terminals.

The present invention was completed based on the above situation and an object thereof is to prevent a short circuit between terminals.

SUMMARY OF THE INVENTION

The invention relates to a connector with a first and second housing that are connectable to one another. Terminals cross between connecting surfaces that face in a connecting direction in a connected state of the two housings. A lock arm is provided on the first housing and is configured to lock the two housings in the connected state. First foreign substance entrance preventing portions are provided on the connecting surfaces in the connecting direction at positions of a projection of the lock arm so that foreign substances from outside the housings cannot enter between the connecting surfaces. Second foreign substance entrance preventing portions are provided at positions of the connecting surfaces corresponding to the terminals so that a foreign substance that has entered between the connecting surfaces cannot contact the terminals.

The connector may be used in oil, such as lubricant, and foreign substances, such as metal powder and metal pieces, may float in the oil. Foreign substances in the oil outside the housings easily can pass around a peripheral part of the lock arm to enter between connecting surfaces even if the housings are locked in a connected state. A clearance generally is provided around the lock arm for allowing displacement of a lock arm. One of the housings may be pulled, thereby separating the housings sufficiently in a separating direction to permit foreign substances to enter more easily from the periphery of the lock arm into the space between the connecting surfaces. However, the above-described connector has the first foreign substance entrance preventing portions so that foreign substances from outside cannot enter through a clearance around the lock arm and into the space between the connecting surfaces of the housings. Further, the second foreign substance entrance preventing portions ensure that any foreign substance that enters between the connecting surfaces cannot contact and short the terminals.

A front part of the lock arm in the connecting direction may be arranged behind the connecting surface of the first housing in the connecting direction. Additionally, the first foreign substance entrance preventing portions may include first and second blocking surfaces. The first blocking surface may be formed between the front part of the lock arm in the connecting direction and the connecting surface of the first housing and may extend in the connecting direction in the first housing. The second blocking surface may extend in the connecting direction from the connecting surface of the second housing in the second housing and may be arranged proximately to face the first blocking surface when the two housings are connected. Accordingly, a foreign substance cannot pass through the clearance around the lock arm in the direction intersecting the connecting direction and enter between the connecting surfaces.

The second housing may include a projection projecting forward in the connecting direction from the connecting surface of the second housing to face the lock arm in the connecting direction, and the second blocking surface may be formed on the projection.

The first blocking surface may be flush with a surface of the first housing where the lock arm is formed. Thus, the first blocking surface can be provided without complicating the shape of the first housing.

The second foreign substance entrance preventing portions may include a projection projecting from one of the connecting surfaces toward the other and a recess formed on the other connecting surface. The foreign substance entrance preventing projection and the foreign substance entrance preventing recess engage to cross between the connecting surfaces when the housings are connected. The engagement of the foreign substance entrance preventing projection and the foreign substance entrance preventing recess defines intricate interface between the connecting surfaces and can prevent foreign substances from contacting the terminals.

The terminals may project from the one connecting surface where the foreign substance entrance preventing projection is formed and the foreign substance entrance preventing projection may be formed at base end parts of the terminals. This configuration avoids enlarging the housings in the connecting direction as compared with the case where the foreign substance entrance preventing projections project from the leading ends of the housings.

The foreign substance entrance preventing projection may cover the base end parts of the terminals over the entire circumference. Thus, the foreign substance entrance preventing projection and the foreign substance entrance preventing recess enclose each terminal for reliably preventing contact of foreign substances with the terminals.

DETAILED DESCRIPTION OF THE PREFERRED EMBODIMENTS

A connector in accordance with an embodiment of the invention is identified by the numeral 10 in FIGS. 1 to 11. The connector 10 is to be mounted, for example, in a round mounting hole (not shown) in a case of an automatic transmission of an automotive vehicle. One end of the connector 10 is arranged in lubricant in the case when the connector 10 is mounted into the mounting hole, and foreign substances, such as metal powder and metal pieces float in the lubricant. The other end of the connector 10 is arranged outside the case.

Figure 1:
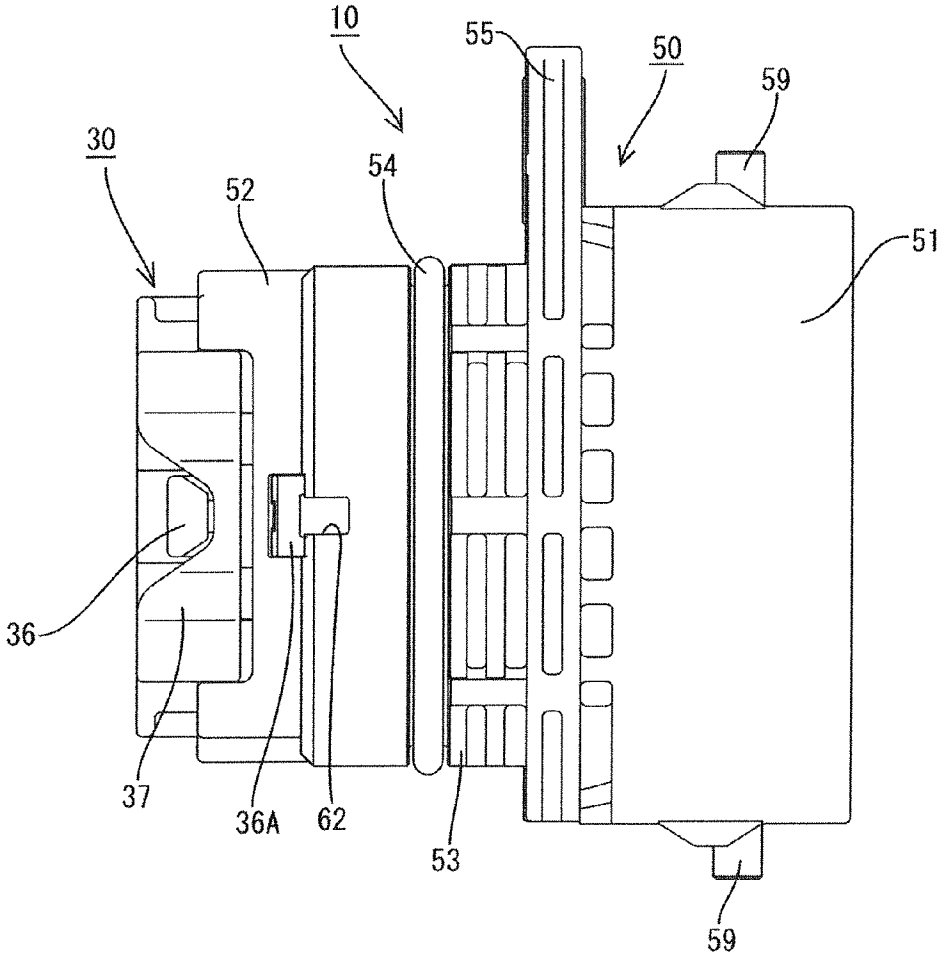
FIG. 1 is a bottom view showing a state where a first housing and a second housing are locked in a connected state.
Figure 2:
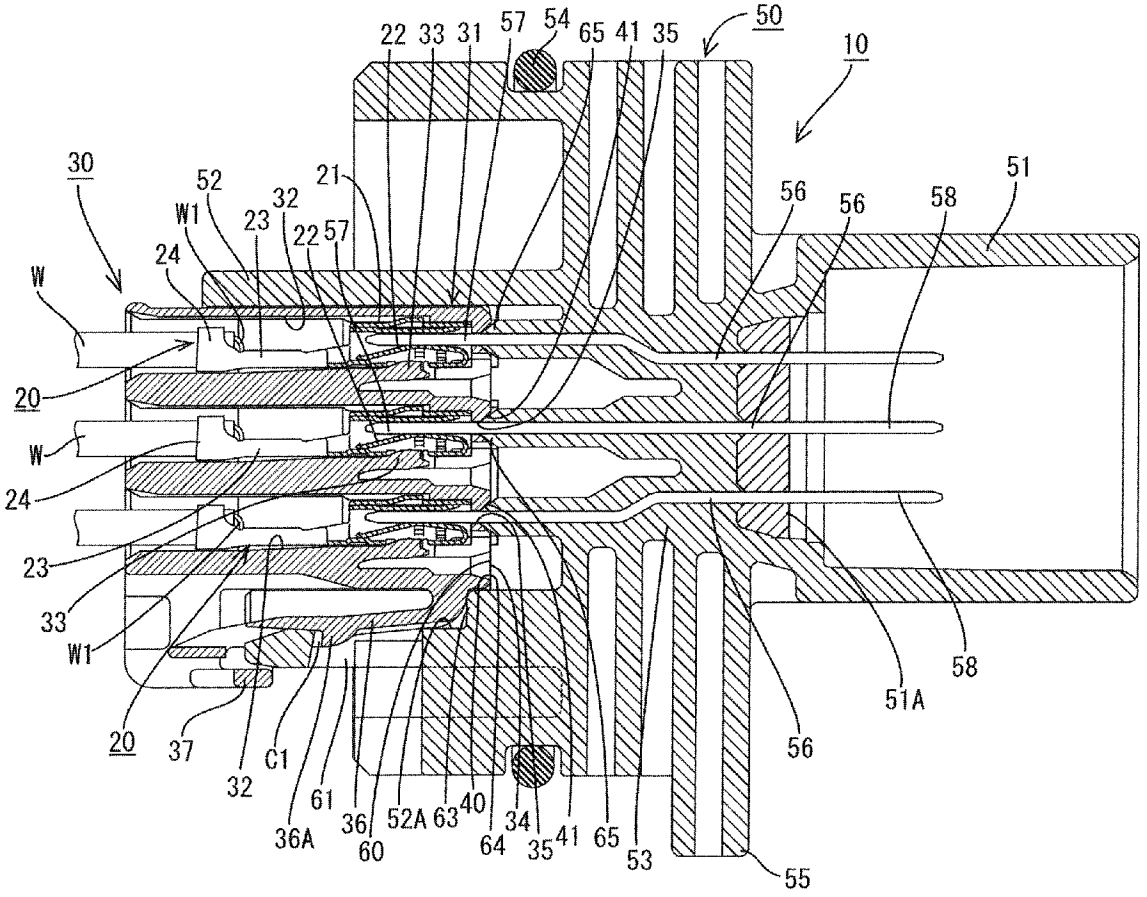
FIG. 2 is a longitudinal section showing a state where the first and second housings are locked in the connected state.

As shown in FIGS. 1 and 2, the connector 10 includes a first housing 30 to be arranged in the case, a housing with a lever (not shown) to be arranged outside the case, and a second housing 50 to be mounted in the mounting hole of the case to connect the first housing 30 and the housing with the lever. Note that, in the following description, a vertical direction is based on a vertical direction in FIG. 2, forward and backward directions are based on a connecting direction of the first housing 30 and the second housing 50 in FIG. 2 and sides to be connected to each other are referred to as front sides.

Figure 6:
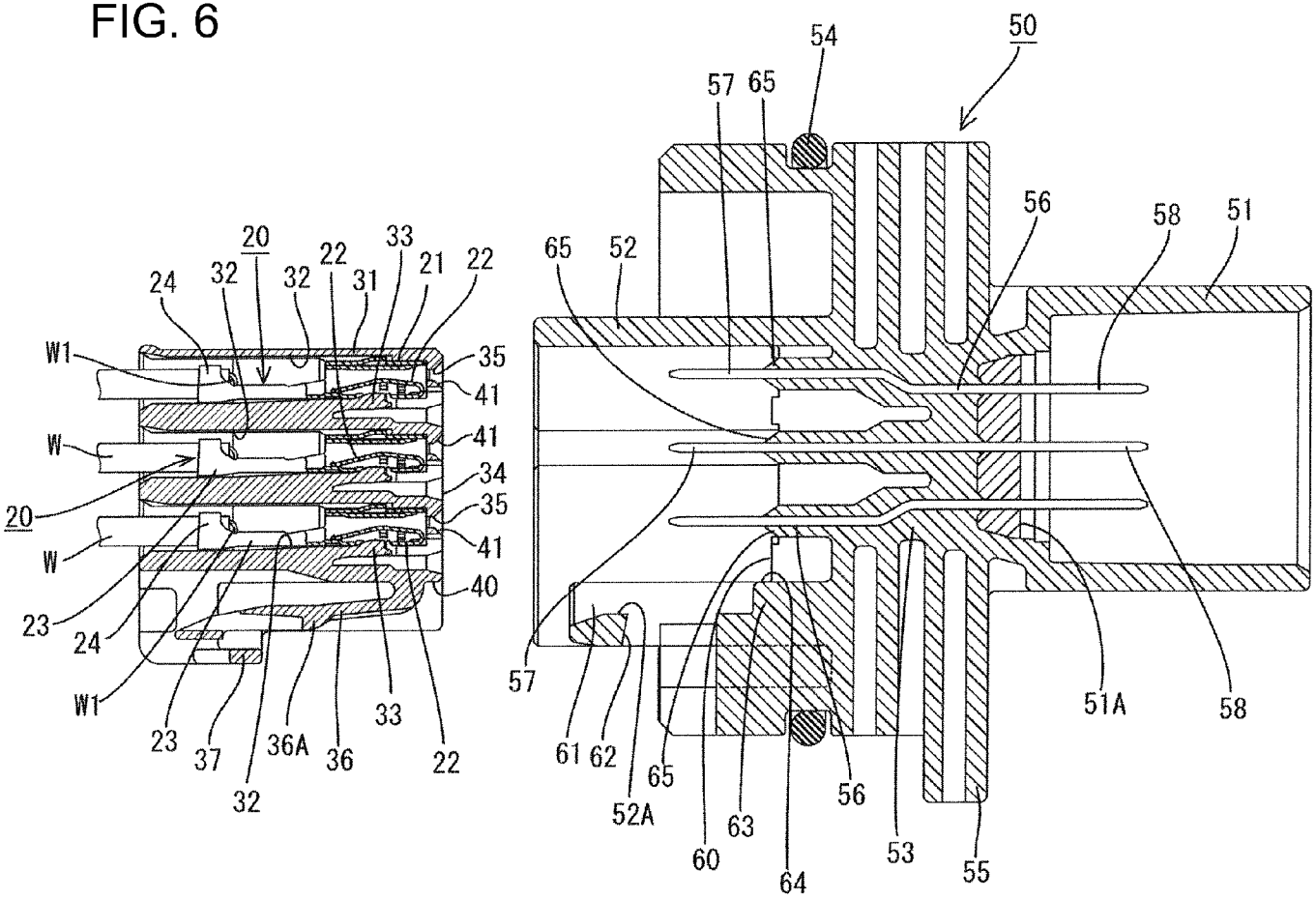
FIG. 6 is a longitudinal section showing a state before the first and second housings are connected.
Figure 7:
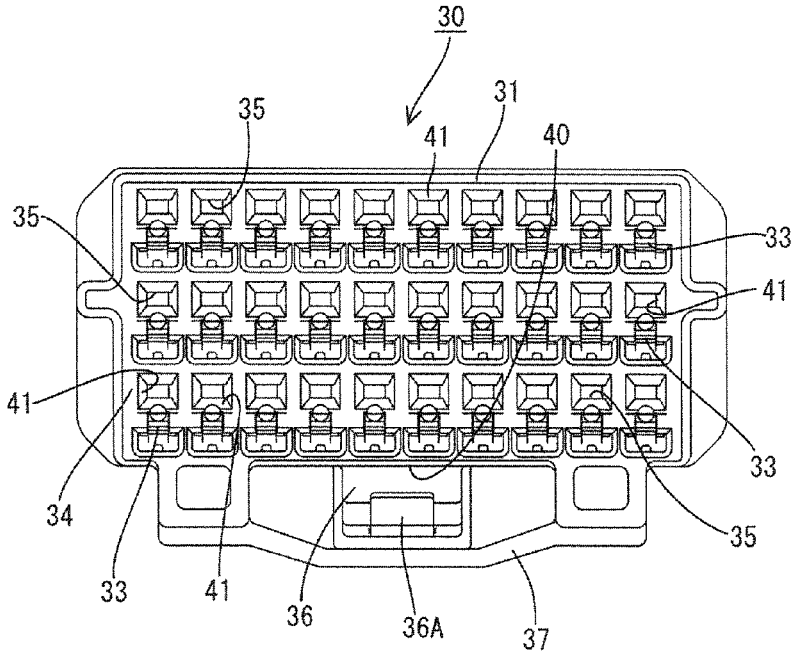
FIG. 7 is a front view of the first housing.

The first housing 30 is made of synthetic resin and includes a wide block-shaped fitting 31, as shown in FIG. 7. As shown in FIGS. 2 and 6, a plurality of cavities 32 are arranged in the vertical and lateral directions in the fitting 31 and female terminals 20 are inserted into the cavities 32 from behind.

The female terminal 20 is formed by press-working a metal plate material with excellent electrical conductivity and includes a box-shaped connecting portion 21 and a wire crimping portion 23. The box-shaped connecting portion 21 is open forward and backward and a resiliently deformable resilient contact piece 22 is provided therein. The wire crimping portion 23 is behind the connecting portion 21 and includes a barrel 24 to be crimped and connected to an insulation coating of a wire W and a core W1 exposed at an end of the wire W.

A resin lance 33 is formed at the bottom wall of the cavity 32 and engages the properly inserted female terminal 20 from behind to retain the female terminal 20 in the fitting 31.

A first connecting surface 34 is formed at the front end of the fitting 31 and extends vertically substantially perpendicular to the connecting direction. Substantially rectangular terminal insertion openings 35 penetrate the first connecting surface 34 in forward and backward directions at positions corresponding to the cavities 32.

A lock arm 36 is cantilevered extending obliquely back from the lower surface of the fitting 31 and is resiliently deformable in vertically with a base end as a support.

A protecting portion 37 is provided on the lower surface of the fitting portion 31 for protecting the lock arm 36. The protecting portion 37 covers both left and right surfaces and the lower surface of the lock arm 36 and protects the lock arm 36 from damage caused by inadvertent contact with another member.

The second housing 50 is made of synthetic resin and is open forward and backward. More particularly, the second housing 50 includes a fitting recess 51 to be arranged outside the case and an accommodating portion 52 to be arranged inside the case. A terminal holding portion 53 is located between the fitting recess 51 and the accommodating portion 52 and is to be mounted into the mounting hole of the case.

The cylindrical terminal holding portion 53 covers a rear side of the accommodating portion 52 over the entire circumference. A rubber ring 54 is mounted on the outer peripheral surface of the terminal holding portion 53 for sealing between the terminal holding portion 53 and the mounting hole when the terminal holding portion 53 is mounted into the mounting hole of the case. A mounting piece 55 bulges out at a rear end of the terminal holding portion 53 and a bolt insertion hole 55A penetrates the mounting piece 55 in forward and backward directions. A bolt is inserted through the bolt insertion hole 55A to fix the second housing 50 to the case.

Intermediate terminals 56 are arranged in the accommodating portion 52 and the fitting recess 51 and are held in the vertical and lateral directions in the terminal holding portion 53. A front connecting portion 57 is formed on a front end part of the intermediate terminal 56 for connection to the female terminal 20 of the first housing 30, and a rear connecting portion 58 is provided on a rear end part of the intermediate terminal 56 for connection to a terminal in the housing with the lever.

The fitting recess 51 is open backward and the rear connecting portions 58 of the intermediate terminals 56 project back from a back wall 51A of the fitting recess 51. Two cam pins 59 are provided on the outer wall of the fitting recess 51. The cam pins 59 enter the cam grooves (not shown) in the lever when the fitting recess 51 and the housing with the lever are fit together. Operating the lever generates a cam action between the cam pins 59 and the cam grooves to pull the fitting recess 51 and the housing with the lever toward each other and connects the terminals (not shown) in the housing with the lever to the rear connecting portions 58.

Figure 8:
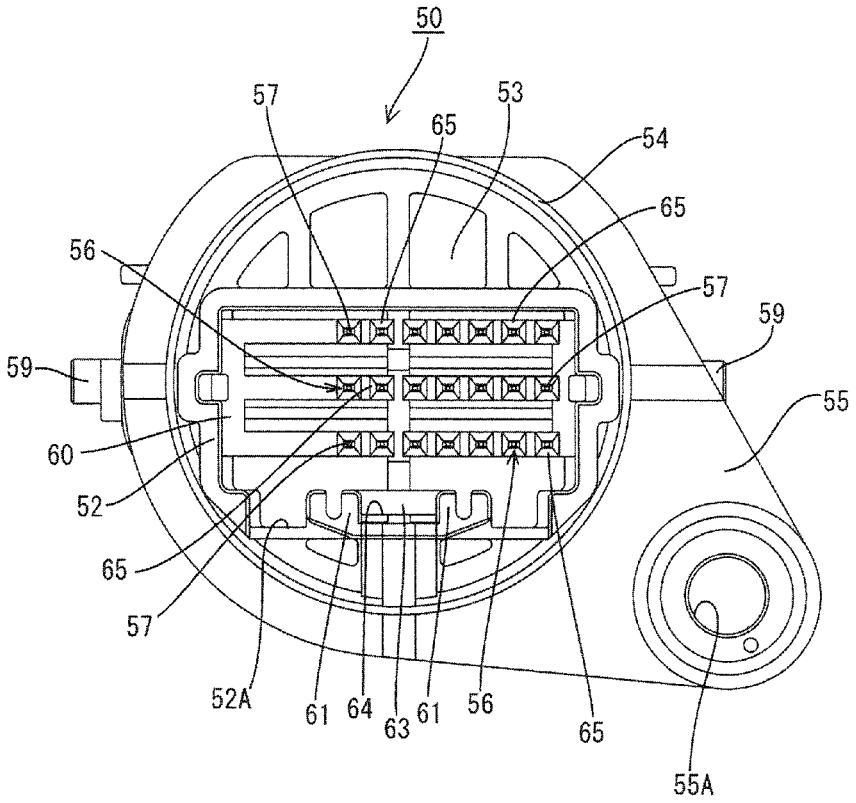
FIG. 8 is a front view of the second housing.

As shown in FIGS. 6 and 8, the accommodating portion 52 opens forward and the fitting 31 of the first housing 30 can fit into the accommodating portion 52. A second connecting surface 60 is provided on a back part of the accommodating portion 52 and faces the first connecting surface 34 of the fitting 31 in the connecting direction when the accommodating portion 52 and the fitting 31 are fit together. The front connecting portions 57 of the intermediate terminals 56 project forward from the second connecting surface 60 and cross in the connecting direction between the first and second connecting surfaces 34, 60 when the fitting 31 and the accommodating portion 52 are fit together. The front connecting portions 57 of the intermediate terminals 56 pass through the terminal insertion openings 35 formed in the first connecting surface 34 of the fitting 31 and enter the connecting portions 21 of the female terminals 20 in the fitting 31 for connection with the resilient contact pieces 22 in the connecting portions 21.

Two guides 61 stand up from a bottom wall 52A of the accommodating portion 52 and are spaced apart by a distance substantially equal to the lateral width of the lock arm 36. The lock arm 36 is accommodated between the guides 61 when the fitting 31 is fit into the accommodating portion 52.

Figure 5:
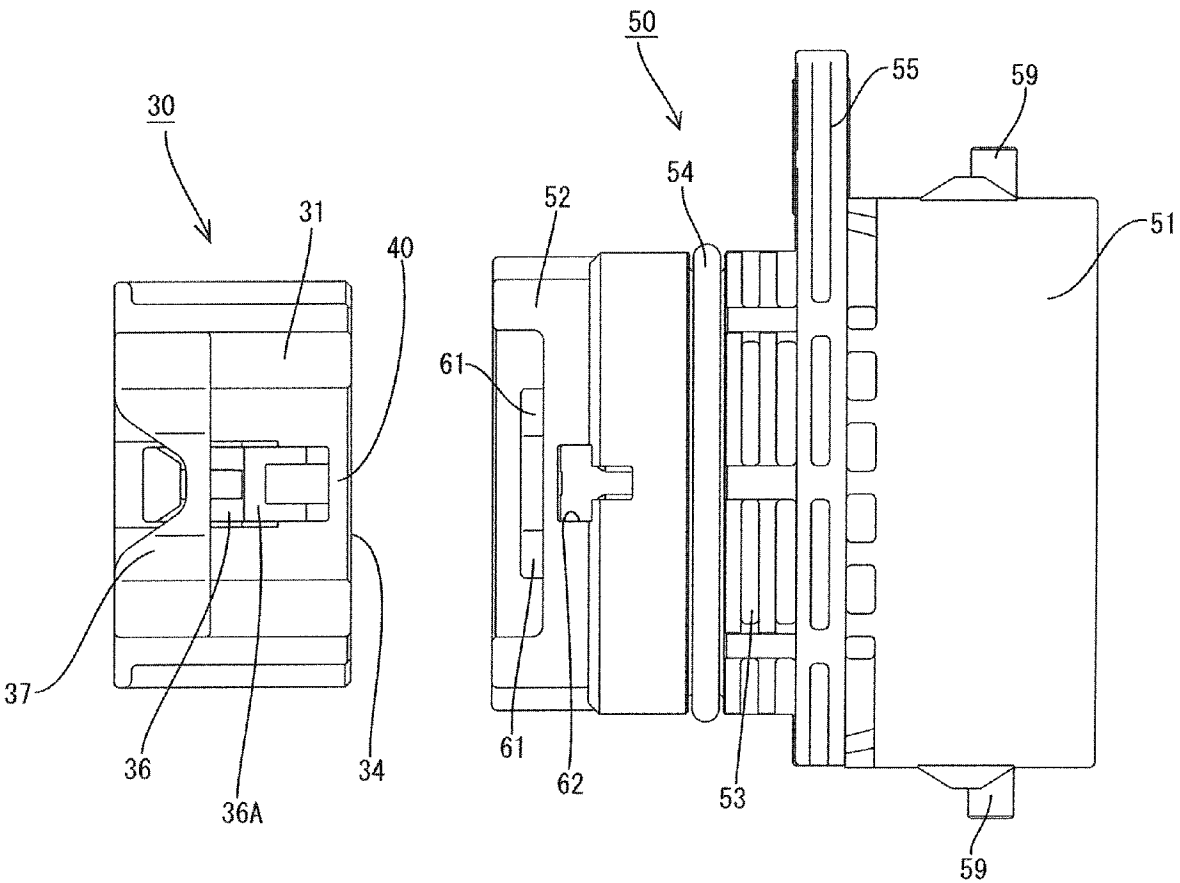
FIG. 5 is a bottom view showing a state before the first and second housings are connected.

A lock hole 62 vertically penetrates the bottom wall 52 of the accommodating portion 52 between the guides 61 and can receive a lock projection 36A provided on the lock arm 36 of the first housing 30. As shown in FIGS. 1 and 5, the lock hole 62 has a substantially T shape with a rear part that is narrower than a front part, and the rear edge of the lock hole 62 is arranged before the second connecting surface 60. The lock projection 36A contacts the opening edge of the accommodating portion 52 as the fitting 31 is urged into the accommodating portion 52 and hence the lock arm 36 deforms up. The lock arm 36 is restored resiliently when the accommodating portion 52 and the fitting 31 are fit together so that lock projection 36A enters the lock hole 62 to lock the accommodating portion 52 and the fitting 31 together. As shown in FIG. 2, a clearance C1 is provided between the lock projection 36A and the lock hole 62 for allowing the lock arm 36 to be displaced along an arcuate path to fit the lock projection 36A into the lock hole 62.

Figure 3:
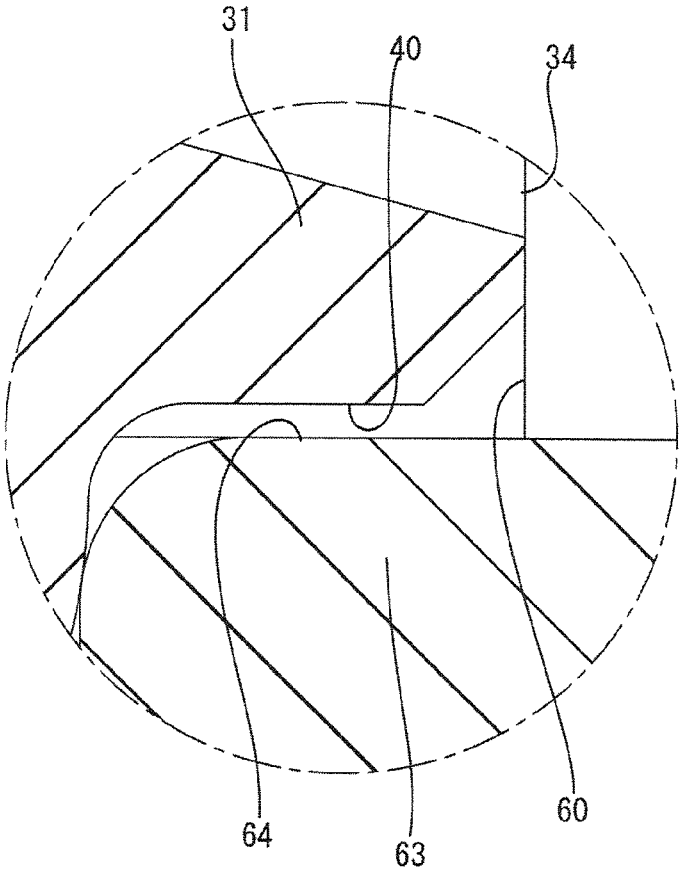
FIG. 3 is an enlarged section of an essential part showing a state where a first blocking surface is arranged to face a second blocking surface in FIG. 2.

As shown in FIGS. 2 and 3, a projection 63 is formed between the guides 61 on the accommodating portion 52 and is arranged near a first blocking surface 40 on the fitting 31. The projection 63 blocks a path that extends vertically from a clearance (not shown) between the first and second connecting surfaces 34, 60 to an outer space of the accommodating portion 52.

The lock arm 36 of the fitting 31 is arranged behind the first connecting surface 34 and the first blocking surface 40 is formed on a front lower part of the fitting 31 and extends in the connecting direction between a front part of the lock arm 36 and the first connecting surface 34. The first blocking surface 40 is flush with the surface where the lock arm 36 is formed, and a lateral dimension of the first blocking surface 40 is substantially equal to a lateral dimension of the lock arm 36.

The projection 63 projects forward from the second connecting surface 60 and faces the lock arm 36 in the connecting direction. Further, the projection 63 is formed over the entire spacing between the guides 61 and has a second blocking surface 64 extending in the connecting direction from the second connecting surface 60 and a surface extending down toward the bottom wall 52A of the accommodating portion 52 from a front end of the second blocking surface 64. The first and second blocking surfaces 40, 64 are near each other and face vertically when the fitting 31 and the accommodating portion 52 are fit together, thereby setting an intricate path extending from the outer space of the accommodating portion 52 to the clearance between the first and second blocking surfaces 40, 64. Note that the first and second blocking surfaces 40, 64 define first foreign substance entrance preventing portions.

Figure 4:
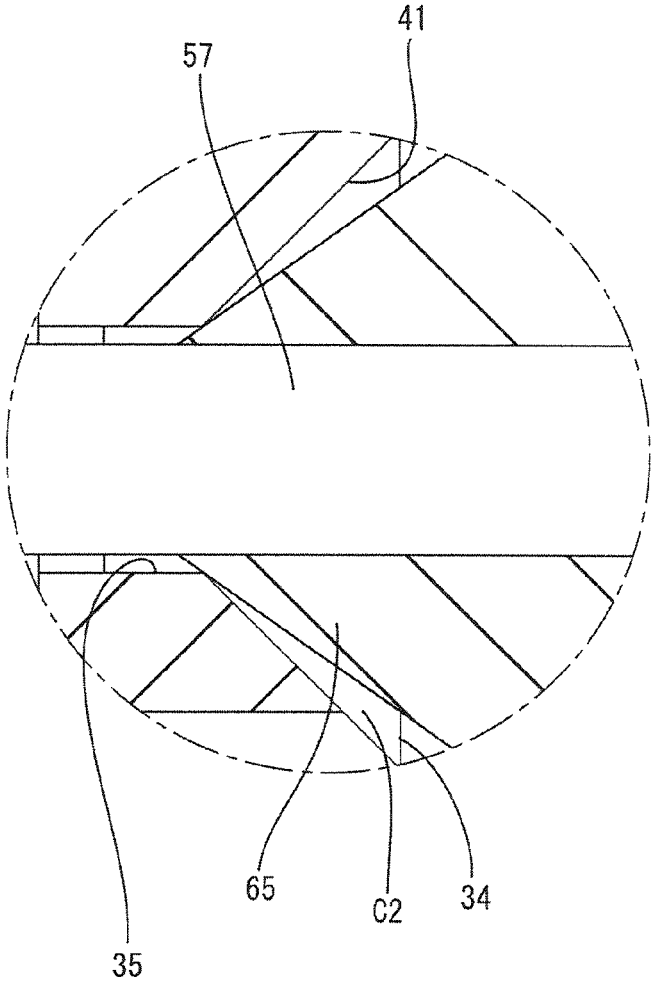
FIG. 4 is an enlarged section of an essential part showing an engaged state of a foreign substance entrance preventing projection and a foreign substance entrance preventing recess in FIG. 2.

As shown in FIGS. 2 and 4, foreign substance entrance preventing projections 65 project from the second connecting surface 60 and individually cover the front connecting portions 57 that cross in the connecting direction between the first and second connecting surfaces 34, 60. The foreign substance entrance preventing projections 65 engage with foreign substance entrance preventing recesses 41 formed on the first connecting surface 34 when the fitting 31 is fit in the accommodating portion 52. Note that the foreign substance entrance preventing recesses 41 and the foreign substance entrance preventing projections 65 define second foreign substance entrance preventing portions.

The foreign substance entrance preventing projections 65 are formed individually on base end parts of the front connecting portions 57 projecting from the second connecting surface 60. Further, the foreign substance entrance preventing projections 65 cover the base end parts of the front connecting portions 57 over the entire circumference and have a substantially four-sided pyramid shape tapered toward the front.

On the other hand, the foreign substance entrance preventing recesses 41 are formed over the entire circumference on the front opening edges of the terminal insertion openings 35 by gradually widening the front opening edges of the terminal insertion openings 35 in the first connecting surface 34 toward the front, and engage with the front parts of the foreign substance entrance preventing projections 65. Further, a gradual widening angle of the foreign substance entrance preventing recess 41 toward the front is larger than a taper angle of the foreign substance entrance preventing projection 64 toward the front. When the foreign substance entrance preventing projection 65 and the foreign substance entrance preventing recess 41 are engaged, a clearance C2 is formed between the inner surface of the foreign substance entrance preventing recess 41 and the outer surface of the foreign substance entrance preventing projection 65.

Figure 9:
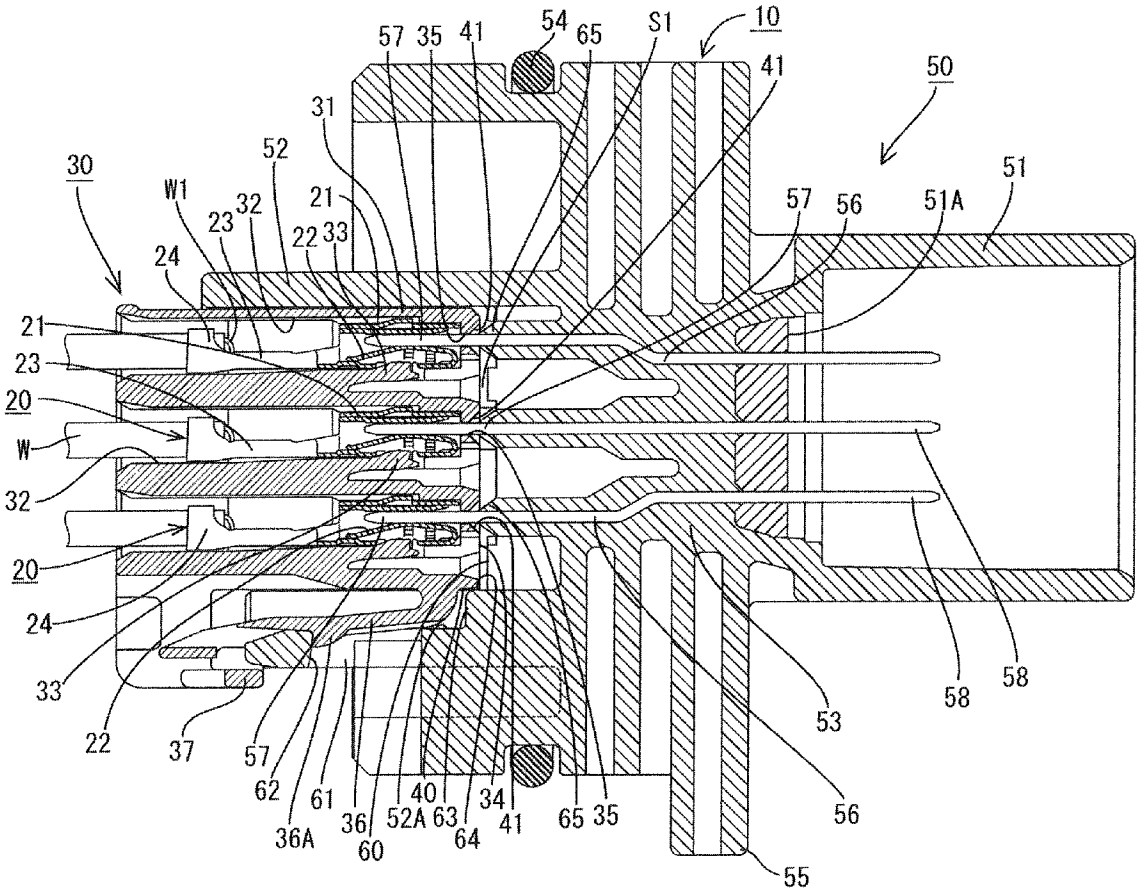
FIG. 9 is a longitudinal section showing a state where the first and second housings are separated in a separating direction while being kept in the connected state.

The first housing 30 and the accommodating portion 52 of the second housing 50 are exposed to the lubricant stored in the case when the connector 10 is mounted into the mounting hole of the case. Foreign substances, such as metal pieces in oil, may enter through the clearance C1 between the lock hole 62 and the lock projection 36A of the lock arm 36 even if the fitting 31 of the first housing 30 and the accommodating portion 52 of the second housing 50 are locked in the connected state. Further, the first and second housings 30, 50 may be separated in a separating direction by the distance C1 while being kept in the connected state, as shown in FIG. 9. Thus, a clearance S1 is formed between the first connecting surface 34 of the fitting 31 and the second connecting surface 60 of the accommodating portion 52, thereby making it easier for foreign substances to enter between the first and second connecting surfaces 34, 60.

Figure 10:
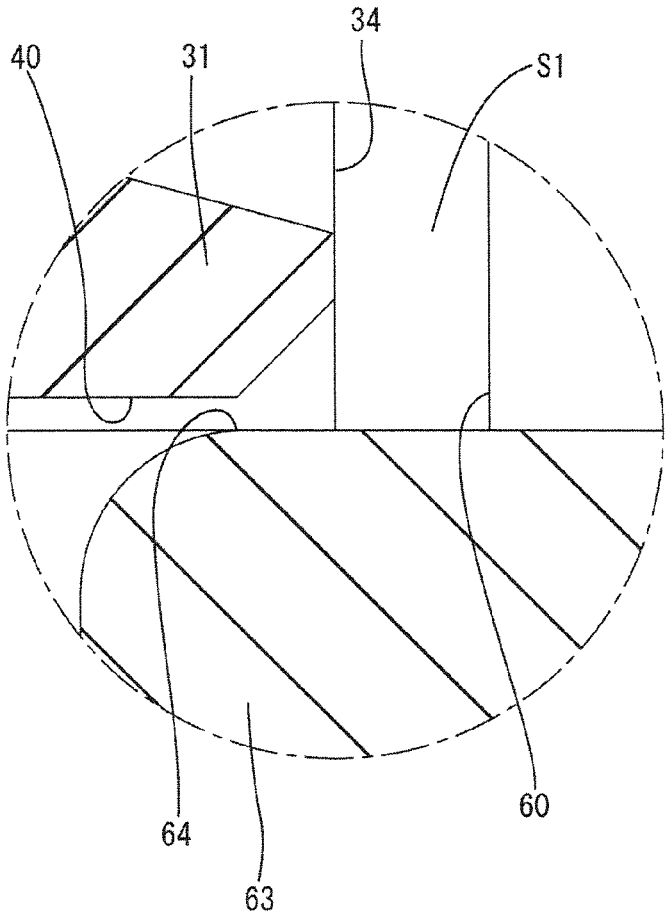
FIG. 10 is an enlarged section of an essential part showing a state where the first blocking surface is arranged to face the second blocking surface in FIG. 9.
Figure 11:
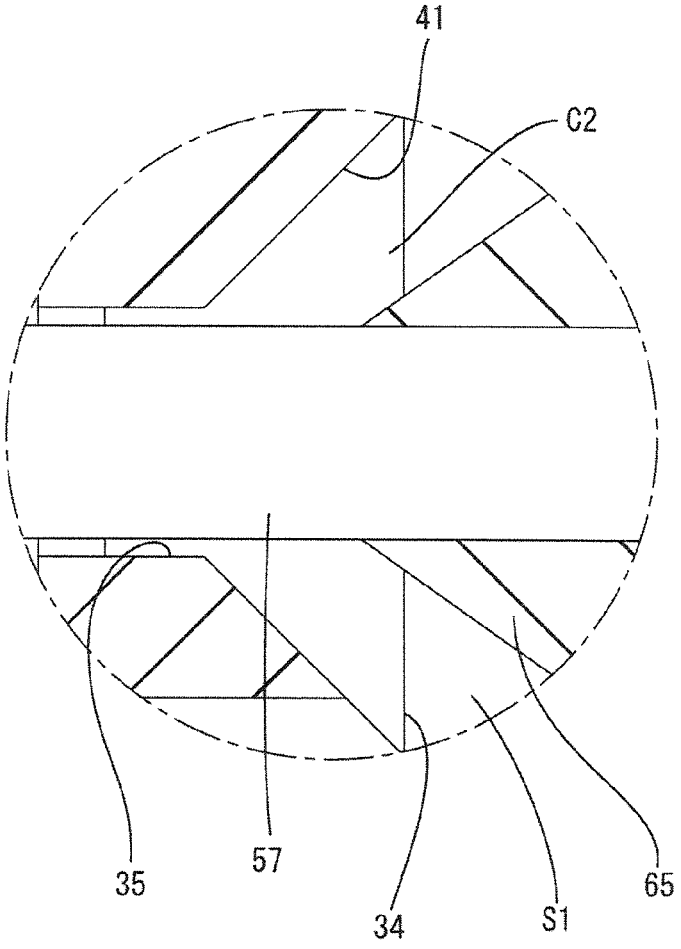
FIG. 11 is an enlarged section of an essential part showing a separated state of the foreign substance entrance preventing projection and the foreign substance entrance preventing recess in FIG. 9.

However, when the fitting 31 and the accommodating portion 52 are fit together, the first blocking surface 40 formed before the lock arm 36 in the fitting 31 and the second blocking surface 64 of the projection 63 formed in the accommodating portion 52 oppose each other vertically, as shown in FIGS. 3 and 10. Thus, an intricate path extends from the outer space of the accommodating portion 52 to the clearance between the first and second connecting surfaces 34, 60, as shown in FIGS. 2 and 9. Thus, foreign substances are not likely to move from outside of the accommodating portion 52, through the clearance C1 around the lock arm 36, and into the clearance between the first and second connecting surfaces 34, 60.

Further, the first blocking surface 40 is formed by arranging the lock arm 36 on the fitting 31 behind the first connecting surface 34 and the second blocking surface 64 is formed by the projecting portion 63 in the accommodating portion 52. Thus, the entry of foreign substances is suppressed without complicating the shape of the connector 10.

The front part of the lock hole 62 is wider than the rear part and the rear edge of the lock hole 62 is before the second connecting surface 60, as shown in FIG. 1. Thus, the path from the lock hole 62 to the clearance between the first and second connecting surfaces 34, 60 is more intricate so that the entry of foreign substances through the lock hole 62 is suppressed further.

The foreign substance entrance preventing recesses 41 engage the foreign substance entrance preventing projections 65 in the connecting direction for individually covering the front connecting portions 57 that cross between the first and second connecting surfaces 34, 60 in the connecting direction, as shown in FIG. 4. Thus, any foreign substance that enters between the first and second connecting surfaces 34, 60 cannot contact the front connecting portions 57 and short circuits between the front connecting portions 57 are avoided.

The foreign substance entrance preventing recesses 41 are formed on the first connecting surface 34 of the fitting 31 and the foreign substance entrance preventing projections 65 are formed on the base end parts of the front connecting portions 57 projecting into the accommodating portion 52. Thus, the first and second housings 30, 50 are not enlarged in the connecting direction as compared with the case where foreign substance entrance preventing projections and foreign substance entrance preventing recesses project from the leading ends of housings.

The invention is not limited to the above described and illustrated embodiment. For example, the following embodiments are also included in the technical scope of the present invention.

The front connecting portions 57 project from the second connecting surface 60 and cross between the first and second connecting surfaces 34, 60 in the connecting direction in the above embodiment. However, connecting portions may project from a first connecting surface and may cross between the first and second connecting surfaces in a connecting direction.

The front surface of the projecting portion 63 extends down from the second blocking surface 64 in the above embodiment. However, the front surface of the projecting portion 63 may extend along the shape of the front end part of the lock arm 36.

The foreign substance entrance preventing projections 65 have a substantially four-sided pyramid shape in the above embodiment. However, foreign substance entrance preventing projections may have a substantially conical shape.

The foreign substance entrance preventing projections 65 are formed on the second connecting surface 60 and the foreign substance entrance preventing recesses 41 are formed on the first connecting surface 34 in the above embodiment. However, foreign substance entrance preventing projections may be on a first connecting surface and foreign substance entrance preventing recesses may be on a second connecting surface.

The foreign substance entrance preventing projections 65 are formed on the base end parts of the front connecting portions 57 and the foreign substance entrance preventing recesses 41 are formed on the opening edges of the terminal insertion openings 35 in the above embodiment. However, foreign substance entrance preventing projections and foreign substance entrance preventing recesses may be formed between adjacent front connecting portions.

The intermediate terminals 56 are held in the terminal holding portion 53 in the above embodiment. However, male terminals may be held in a terminal holding portion.

What is claimed is:

1. A connector, comprising:

a first housing having a first connecting surface;

a second housing connectable to the first housing and having a second connecting surface facing the first connecting surface in a connecting direction when the first and second housings are connected;

terminals crossing between the first and second connecting surfaces when the first and second housings are in a connected state;

a lock arm provided on the first housing and having a front part arranged behind the connecting surface of the first housing in the connecting direction, the lock arm configured to lock the first and second housings in the connected state;

first foreign substance entrance preventing portions on the connecting surfaces at positions aligned with a projecting direction of the lock arm, the first foreign substance entrance preventing portions having a first blocking surface in the first housing between the front part of the lock arm and the first connecting surface and extending in the connecting direction and a second blocking surface extending in the connecting direction from the connecting surface of the second housing and facing the first blocking surface when the housings are in the connected state, the first and second blocking surfaces preventing foreign substances from entering between the connecting surfaces from outside the housings; and second foreign substance entrance preventing portions at positions on the connecting surfaces corresponding to the terminals for preventing foreign substances between the connecting surfaces from contacting the terminals.

2. The connector of claim 1, wherein:

the second housing includes a projection projecting in the connecting direction from the second connecting surface to face the lock arm; and the second blocking surface is formed on the projection.

3. The connector of claim 1, wherein the first blocking surface is flush with a surface of the first housing where the lock arm is formed.

4. The connector of claim 1, wherein:

the second foreign substance entrance preventing portions include a foreign substance entrance preventing projection projecting from one of the connecting surfaces toward the other of the connecting surfaces and a foreign substance entrance preventing recess formed on the other of the connecting surfaces; and the foreign substance entrance preventing projection and the foreign substance entrance preventing recess are engaged to cross between the connecting surfaces when the housings are in the connected state.

5. The connector of claim 4, wherein:

the terminals project from the connecting surface where the foreign substance entrance preventing projection is formed; and the foreign substance entrance preventing projection is formed on base end parts of the terminals.

6. The connector of claim 5, wherein the foreign substance entrance preventing projection covers the base end parts of the terminals over an entire circumference.

* * * * *